US007308769B2

(12) United States Patent
Labedz

(10) Patent No.: US 7,308,769 B2
(45) Date of Patent: Dec. 18, 2007

(54) FRAMELESS DISPLAY MODULE, DEVICE AND METHOD

(75) Inventor: Lawrence Labedz, Naperville, IL (US)

(73) Assignee: Keyser Industries, Inc., Everygreen Park, IL (US)

( * ) Notice: Subject to any disclaimer, the term of this patent is extended or adjusted under 35 U.S.C. 154(b) by 93 days.

(21) Appl. No.: 10/801,724

(22) Filed: Mar. 16, 2004

(65) Prior Publication Data

US 2005/0204598 A1 Sep. 22, 2005

(51) Int. Cl.
*G09F 13/04* (2006.01)

(52) U.S. Cl. ..... 40/568; 40/575

(58) Field of Classification Search ..... 40/568, 40/575, 576, 611.08, 618, 490, 585, 574
See application file for complete search history.

(56) References Cited

U.S. PATENT DOCUMENTS

| | | | | |
|---|---|---|---|---|
| 1,258,146 A | | 3/1918 | Russell | |
| 1,831,228 A | | 11/1931 | Clark | |
| 1,841,026 A | | 1/1932 | Greenstone | |
| 1,887,591 A | * | 11/1932 | Fugita | 40/618 |
| 2,057,064 A | | 10/1936 | Shively et al. | |
| 2,079,230 A | | 5/1937 | Shively | |
| 2,308,556 A | * | 1/1943 | Walker | 40/618 |
| 2,319,910 A | | 9/1943 | Adler | |
| 2,561,813 A | | 7/1951 | Murphy | |
| 2,976,634 A | | 3/1961 | Ashley | |
| 3,013,475 A | | 12/1961 | Spangler | |
| 3,419,978 A | * | 1/1969 | Ostrand | 40/585 |
| 3,531,884 A | * | 10/1970 | Adler | 40/618 |
| 3,673,720 A | | 7/1972 | Thomton | |
| 3,685,186 A | | 8/1972 | Goodman | |
| 3,707,792 A | * | 1/1973 | Mabrey et al. | 40/219 |
| 3,905,139 A | | 9/1975 | Cooper | |
| 3,939,584 A | | 2/1976 | Trame | |
| 4,111,307 A | | 9/1978 | Peggs | |
| 4,138,787 A | * | 2/1979 | Sarkisian et al. | 40/618 |
| 4,171,584 A | * | 10/1979 | Kaiser | 40/490 |
| 4,345,396 A | | 8/1982 | Janssen | |
| 4,364,616 A | * | 12/1982 | Harkins et al. | 40/568 |
| 4,367,604 A | | 1/1983 | Porter, II et al. | |

(Continued)

FOREIGN PATENT DOCUMENTS

| | | |
|---|---|---|
| WO | WO 90/07173 | 6/1990 |

(Continued)

*Primary Examiner*—Gary C. Hoge
(74) *Attorney, Agent, or Firm*—Ryndak & Suri LLP

(57) ABSTRACT

A display module for an illuminated display device is provided having an at least substantially translucent panel and a plurality of retention members for removably retaining a plurality of spaced apart divider members and display members to the panel. The retention members are secured to the panel in fixed relation to the panel and are arrayed in first and second opposed vertically spaced apart columns. Preferably, each divider member includes retaining structures, and preferably longitudinally extending channels, for retaining portions of at least partially translucent display members bearing food, pricing, or other advertising information in a predetermined position between opposed sets of retaining structures. An illuminated display device is also provided which includes a housing having an opening, at least one lighting source inside the housing for projecting light through the opening, and a display module. A method of assembling a display module in accordance with the invention is further provided.

27 Claims, 6 Drawing Sheets

U.S. PATENT DOCUMENTS

| | | | | | |
|---|---|---|---|---|---|
| 4,461,107 | A | | 7/1984 | Grate | |
| 4,521,984 | A | | 6/1985 | Murray | |
| 4,553,345 | A | * | 11/1985 | Bercier et al. | 40/576 |
| 4,593,486 | A | | 6/1986 | Visocky et al. | |
| 4,606,141 | A | | 8/1986 | Murray | |
| 4,653,209 | A | * | 3/1987 | Cobb | 40/618 |
| 4,682,430 | A | | 7/1987 | Ramsay | |
| 4,693,026 | A | * | 9/1987 | Callahan et al. | 40/576 |
| 4,753,026 | A | | 6/1988 | Woodman et al. | |
| 4,817,316 | A | * | 4/1989 | Walker | 40/576 |
| 4,827,644 | A | | 5/1989 | Trame | |
| 4,977,698 | A | | 12/1990 | Seggerson | |
| 5,065,537 | A | * | 11/1991 | Bailey | 40/618 |
| 5,636,463 | A | | 6/1997 | Sharon et al. | |
| 5,682,694 | A | | 11/1997 | Hillstrom | |
| 5,901,486 | A | | 5/1999 | Sharon et al. | |
| 5,983,543 | A | | 11/1999 | Hillstrom | |
| 6,125,565 | A | | 10/2000 | Hillstrom | |
| 6,178,678 | B1 | * | 1/2001 | Stoddard | 40/618 |
| 6,298,589 | B1 | | 10/2001 | Hillstrom | |
| 6,631,576 | B2 | | 10/2003 | Hillstrom | |

FOREIGN PATENT DOCUMENTS

| | | |
|---|---|---|
| WO | WO 92/03814 | 3/1992 |
| WO | WO 97/20299 | 6/1997 |

* cited by examiner

FRAMELESS DISPLAY MODULE, DEVICE AND METHOD

FIELD OF THE INVENTION

This invention relates to a frameless display module and an illuminated display device incorporating one or more of the modules. Such display devices are particularly suitable for indoor or outdoor use, such as at restaurants, for example.

BACKGROUND OF THE INVENTION

Various display boards are known in the art, such as illuminated menu display boards, which are commonly utilized at fast-food restaurants, for example, to display food items, associated pricing, advertised specials, and other information. These menu display boards are commonly used in outdoor locations at "drive-through" windows and behind and above typical restaurant counters. Changes to the displayed information frequently need to be made due to customer demand, menu changes, pricing changes, or for other reasons. Thus, there is a need for a menu display board wherein the displayed information is easily changed and yet is of simple construction.

SUMMARY OF THE INVENTION

In accordance with one aspect of the present invention, a self-supporting frameless display module is provided that is adapted to be disposed within an illuminated display device. The frameless display module is composed of a self-supporting at least substantially translucent panel, a plurality of retention members secured to the panel in fixed relation and arrayed in first and second vertical columns that are horizontally spaced apart, a plurality of opposed, horizontally disposed divider members positioned over the panel and each of the divider members being individually removably held in place by opposed retention members. A retaining structure is provided on each of the divider members for retaining portions of the display members in a predetermined position with respect to the panel. A plurality of display members are positioned between opposed sets of the channels of the opposed divider members. The display members have translucent portions thereby allowing light to pass therethrough. The display module permits the divider members to be removed and replaced in the opposed retention members without disassembling of any of the retention members from the panel, thereby permitting the display members to also be so removed and replaced. The frameless display module can be constructed to permit it to be easily inserted into and removed from a housing of an illuminated display device. Preferably, the panel is transparent.

In accordance with one aspect of the present invention, the illuminated display device includes a housing having an opening, at least one lighting source positioned inside the housing for projecting light through the opening, and at least one display module removably disposed within the opening in the housing. Additionally, the housing preferably further includes a door that can be connected to the housing by any suitable manner, including hinges. The display modules can be viewed, such as by a customer, through the door when the door is in its normal or closed position.

The display module that may be used in the illuminated device includes a self-supporting, transparent or at least substantially translucent panel and a plurality of retention members secured to the panel in fixed relation to the panel and arrayed in first and second opposed vertical columns that are horizontally spaced apart. By "secured to" it is meant that the retention members may be directly secured to the panel, indirectly secured to the panel by an intermediate member, or integrally formed as part of the translucent panel.

In one embodiment, the display module includes a pair of spaced apart, opposed, and vertically elongated members or intermediate members that include or carry the retention members that may be secured to the vertically elongated member. The elongated members are arrayed in first and second opposed vertical (which includes generally vertical) spaced columns and serve as an intermediary to secure retention members to the panel. The elongated members may be secured to the panel in any suitable manner. For example, the elongated members can be secured by numerous types of fasteners that may also extend through corresponding apertures in the panel and corresponding apertures in the elongated members. Non-limiting examples include rivets, nuts and bolts, screws, other threaded fasteners, clips, welds and adhesives. Any other suitable material or structure for securing the retention members to the vertically elongated members may be used as may be known in the art.

In accordance with another aspect of the present invention, the display module further includes a plurality of opposed, horizontally disposed divider members positioned over the panel. The plurality of divider members each includes a retaining structure for retaining portions of display members as will be discussed below. Additionally, each of the plurality of divider members is removably held in place by the opposed retention members such that the divider members can be removed and replaced in the opposed retention members without disassembly of any of the retention members from the panel.

In accordance with another embodiment of the present invention, each divider member has a male portion and the retention members include a mating female portion such that the dividing members are held in place by opposed retention members and, of course, this arrangement may be reversed, with the divider member having the female portion and the retention member having the male portion. Thus, in one embodiment, each divider member has a front portion with an "H-shaped" cross-section and an integral rear portion. The "H-shaped" cross-section defines an opposed pair of longitudinally extending channels in each of the divider members for retaining the display members in the display module. The integral rear portion of the divider member defines an inwardly extending clip member adapted to be releasably engageable within an opposed pair of retention members. Preferably, the divider members are engaged to the retention members in a direction perpendicular to the plane of the panel.

In accordance with another aspect of the present invention, the display module includes a plurality of display members which are positioned between opposed sets of opposed divider members. Typically, for a restaurant, the divider members can be used to display food information, pricing information, advertised specials, or other information. Typically, each display member includes a translucent portion such that light can shine through the divider member to convey the advertised information when the display module is disposed within an opening of the illuminated display device. Each display member is retained within a retaining structure on the divider member in a predetermined position. Typically, display members are plastic or some other flexible material such that the display member may be flexed if desired in order to be inserted within the restraining structures of two adjacent display members. However, the display members may be of any other suitable material, typically having a translucent portion.

In one embodiment, each display member includes a longitudinally extending channel for retaining portions of the display members within the divider member. In another embodiment, the display module includes a post-and-hole arrangement where each divider member has at least two apertures which correspond to at least two apertures on an associated display member. Once the apertures of the divider member and display member are aligned, a peg or other suitable member may be inserted in the apertures to retain at least a portion of the display member to the divider member. Alternatively, any other suitable arrangement to retain display members between two adjacent divider members may be provided.

In accordance with another aspect of the present invention, a method of assembling a display module is provided comprising securing a plurality of opposed pairs of retention members to an at least substantially translucent panel in fixed relation to the panel and arrayed in first and second opposed vertically spaced apart columns; removably securing a plurality of opposed, horizontally disposed divider members to respective opposed pairs of the retention members, each of the divider members having a retaining structure thereon for retaining display members; and positioning in a retaining relationship a plurality of display members between opposed sets of divider members, wherein the display members have translucent portions.

Other advantages and features of the invention will become apparent from the following description and from reference to the drawings.

DETAILED DESCRIPTION

Figure 1:
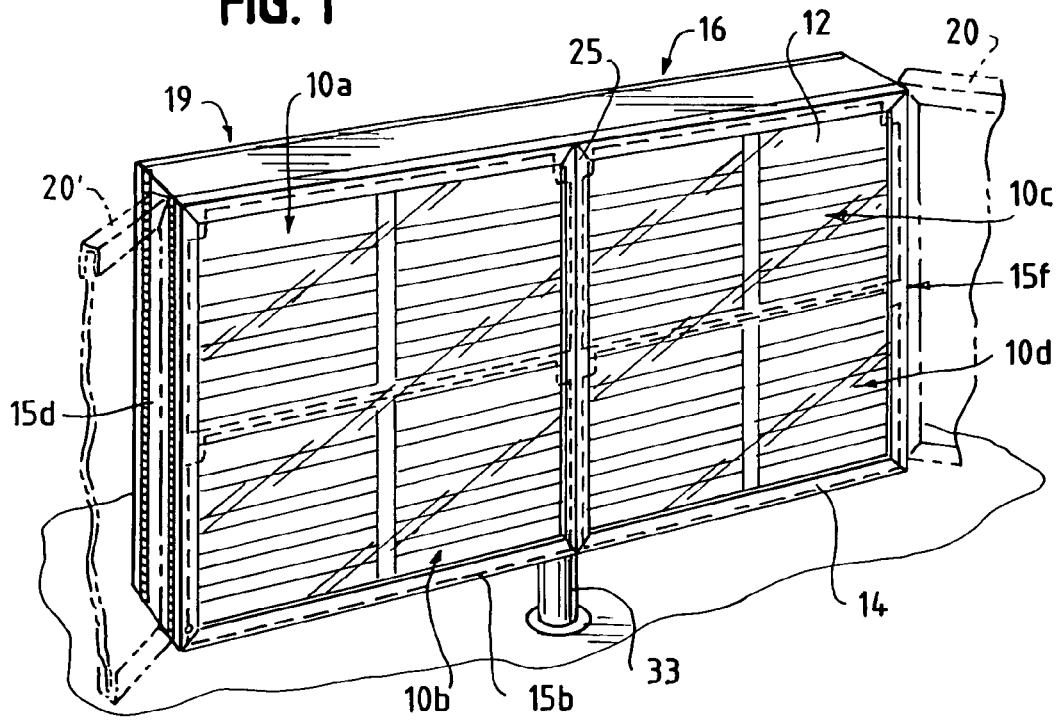
FIG. 1 is a front perspective view illustrating an illuminated display device in accordance with the present invention.

While this invention is susceptible of embodiment in many different forms, there is shown in the drawings and described in detail herein, several specific embodiments with the understanding that the present disclosure is to be considered as exemplifications of the principles of the invention and is not intended to limit the invention to the embodiments illustrated.

In accordance with one aspect of the present invention, a self-supporting frameless display module is provided which includes a panel having a plurality of divider members and display members which can easily be removed and replaced in opposed retention members without disassembly of any of the retention members from the panel. The self-supporting frameless display module may be removably disposed within an opening of a housing of an illuminated display device to provide a fully illuminated display device suitable for either an indoor or outdoor environment.

Figure 2:
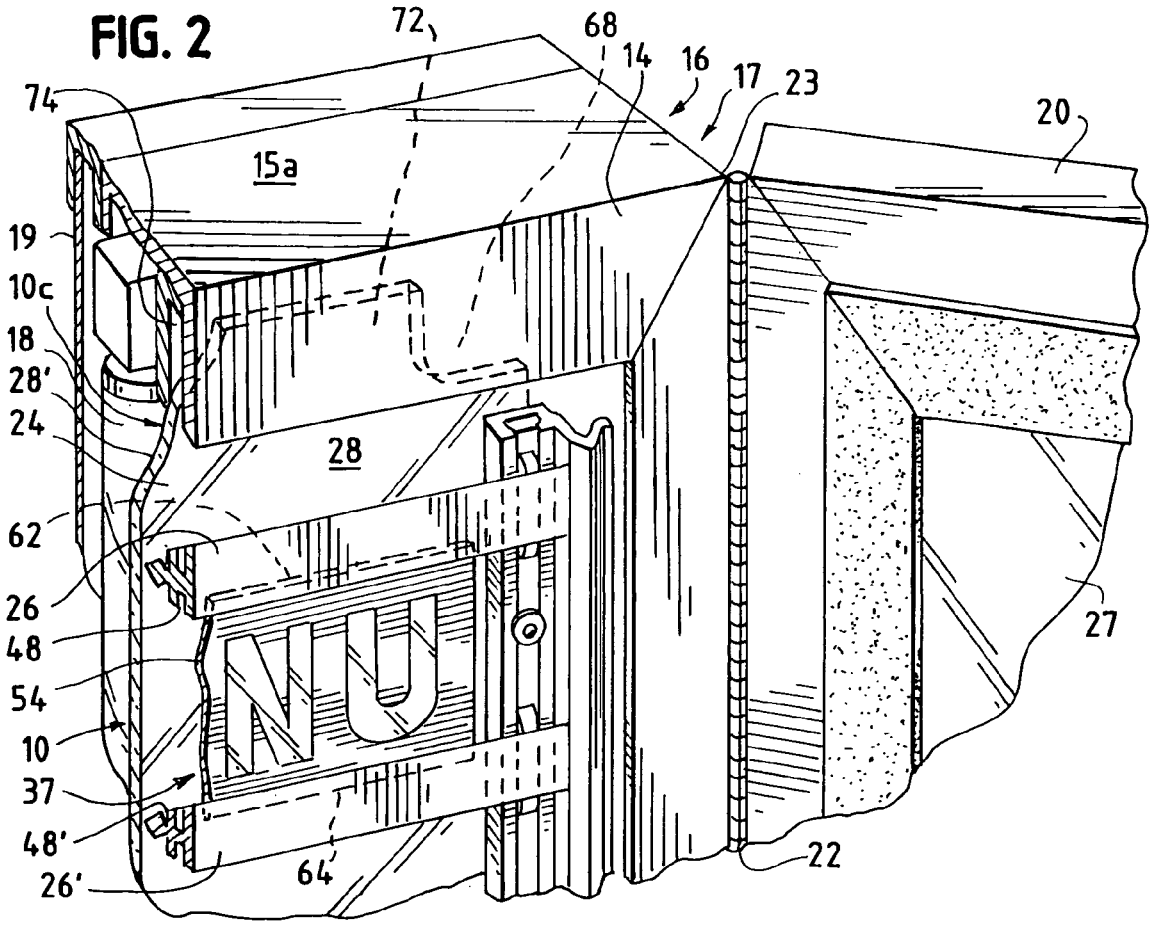
FIG. 2 is a front perspective fragmentary view of the illuminated display device of FIG. 1 in an opened position.

Referring to the figures generally, and in particular to FIG. 1, a plurality of self-supporting frameless display modules 10*a*-10*d* are shown generally and disposed within an opening 12 of a housing 14 of an illuminated display device 16. FIG. 2 more particularly illustrates the positioning of display module 10*c* within illuminated display device 16.

As shown in FIGS. 1 and 2, illuminated display device 16 includes a cabinet 17 having housing 14 and transparent doors 20 and 20'. Housing 14 includes lighting source 18 spaced in front of a rear wall 19 of housing 14 to backlight display modules 10*a-d* when display modules 10*a-d* are disposed within housing 14. Lighting source 18 preferably includes fluorescent light tubes of a suitable length and wattage, but alternatively any other suitable lighting source can be utilized as is known in the art.

Housing 14 includes at least one door 20 secured to housing 14 via a hinge 22. In one embodiment, door 20 is suitably secured to hinge 22 on a first edge 23 of housing 14, as shown in FIGS. 1-2. Door 20 may have a suitable latching or locking mechanism (not shown) for securing door 20 in a closed position to protect the interior of display modules 10*a-d*. It is contemplated that any number of substantially transparent doors with viewing windows and latching or locking mechanisms may be utilized. For example, FIG. 1 illustrates two doors 20, 20' which may be closed and secured via latching mechanisms located on a vertical member 25 at about the horizontal center of housing 14.

Housing 14 is preferably formed from any desirable relatively rigid and relatively weatherproof material, such as metal or plastic, for example, and preferably aluminum, and which is suitable to protect the housing and door from the deleterious effects of sun, wind, rain, snow, freezing temperatures, and elevated temperatures, particularly when illuminated display device 16 is used in an outdoor environment. Door 20 is also preferably of a weatherproof material and has a transparent portion 27 so as to enable display modules 10*a-d* to be viewed through door 20. Thus, door 20 is preferably glass, but may be any other suitable transparent or substantially translucent material which is substantially weatherproof.

Figure 5:
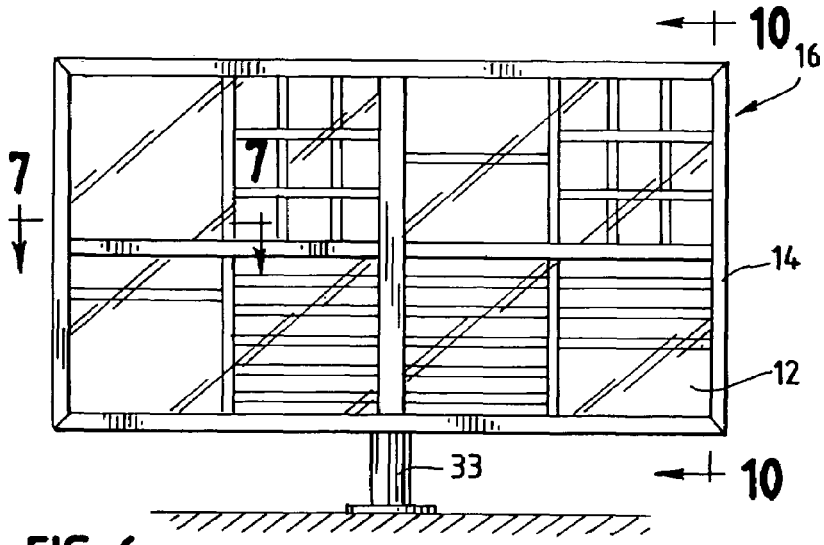
FIG. 5 is a front elevation view illustrating an illuminated display device in accordance with the invention.
Figure 6:
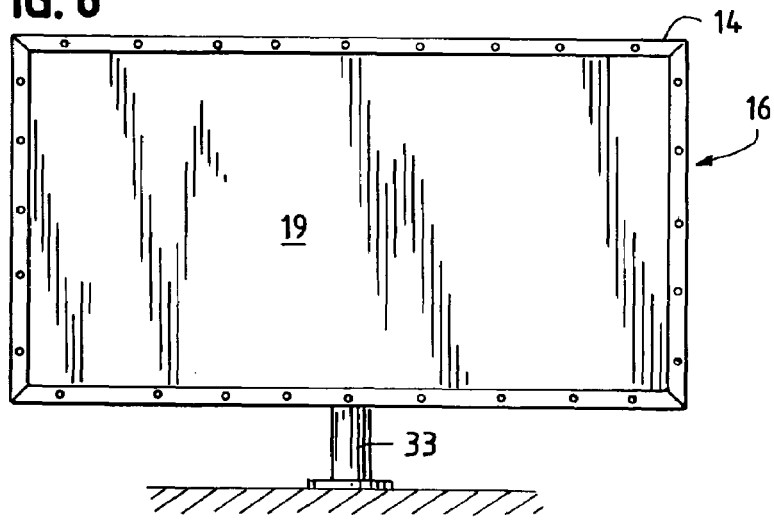
FIG. 6 is a rear elevation view of the illuminated display device of FIG. 5 without a display module disposed therein.

Additionally, housing 14 further includes top and bottom sections 15*a* and 15*b* and side walls 15*d* and 15*f*. Walls 15*a*, 15*d*, 15*f* and vertical member 25 preferably include at least one slot for receiving a corresponding tab of display module 10 when display module 10 is inserted into opening 12 of housing 14 as will be further discussed in detail below. For outdoor use, housing 14 is preferably secured to a suitable base 33 mounted in the ground or a suitable supporting surface (not shown) to add height and to provide stability to housing 14 as shown in FIGS. 1, 5, and 6. Cabinet 17 may be provided with suitable venting (not shown) for the interior.

Typically, display modules 10*a-d* are spaced in front of a suitable lighting source 18, as shown in FIG. 2. Display modules 10*a-d* include a transparent or at least a substantially translucent self-supporting panel 24 having rear side 28', a front face 28, and a plurality of opposed, horizontally disposed divider members 26, 26' positioned over panel 24 on front face 28 of panel 24, as shown in FIG. 2. Divider members 26, 26' are held in place by a plurality of retention members 34, 34', and when in place, divide front face 28 of display modules 10*a-d* into a plurality of horizontal regions 37, 37', as shown by display module 10*a* in FIGS. 3-4.

Panel 24 is constructed of a material which is self-supporting and relatively rigid, such that panel 24 can carry the divider members and the additional components of display modules 10*a-d* as set forth herein without the aid of additional supporting members. Thus, panel 24 may be glass, polycarbonate, Plexiglas, or any other suitable material. Additionally, panel 24 is preferably transparent or at least substantially translucent such that light from light source 18 may shine through at least a portion of panel 24 when display modules 10*a-d* are disposed within illuminated display device 16.

Panel 24 is constructed of a material which is self-supporting and relatively rigid, such that panel 24 can carry the divider members and the additional components of display module 10 as set forth herein without the aid of additional supporting members. Thus, panel 24 may be glass, polycarbonate, plexiglass, or any other suitable material. Additionally, panel 24 is preferably transparent or at least substantially translucent such that light from light source 18 may shine through at least a portion of panel 24 when the display module is disposed within illuminated display device 16.

Figure 3:
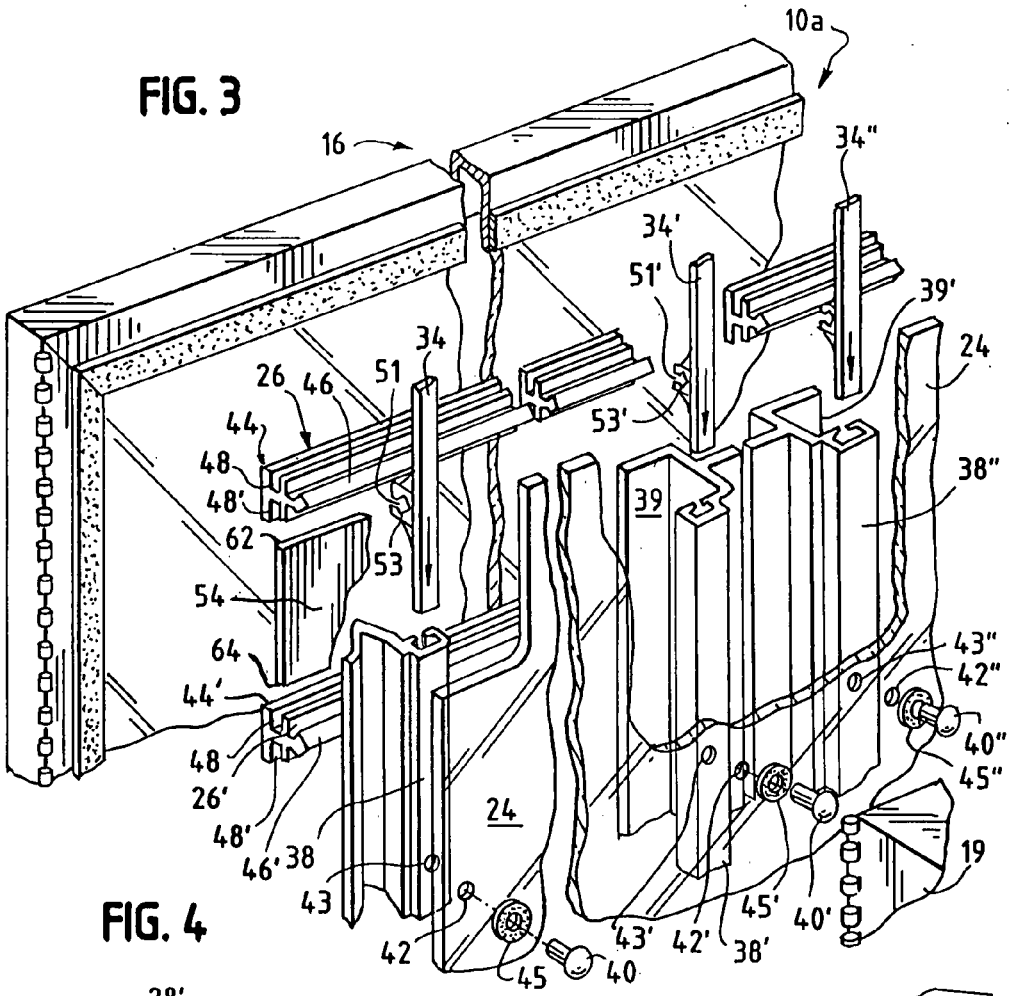
FIG. 3 is a representative rear perspective fragmentary view of a self-supporting display module within the housing of the illuminated display device in accordance with the invention.

Retention members 34, 34', 34", as shown in FIG. 3, are spaced apart as desired and are arrayed in first and second opposed vertically spaced columns. By "secured to," it is meant that the retention members may be directly secured to the panel, indirectly secured to the panel by an intermediate member, or integrally formed as part of the translucent panel.

Thus, for example, in one embodiment, as shown in FIG. 3, display module 10*a* further includes a pair of spaced apart, opposed, and vertically elongated members 38, 38', 38" (intermediate members), which include retention members 34, 34', 34" on a surface thereof. Elongated members 38, 38', 38" are arrayed in first and second opposed vertically spaced columns and serve as an intermediary to secure retention members 34, 34', 34" to panel 24. Further, elongated members 38, 38', 38" are secured to panel 24 by a plurality of spaced apart fasteners, which as illustrated are rivets 40, 40', 40" which extend through corresponding apertures 42, 42', 42" in panel 24 and corresponding apertures 43, 43', 43" in elongated members 38, 38', 38". Suitable washers 45, 45', 45", which may be rubber or another material, may be present between rivets 40, 40' and 40" and panel 24 when securing elongated members 38, 38', 38" to panel 24.

Figure 4:
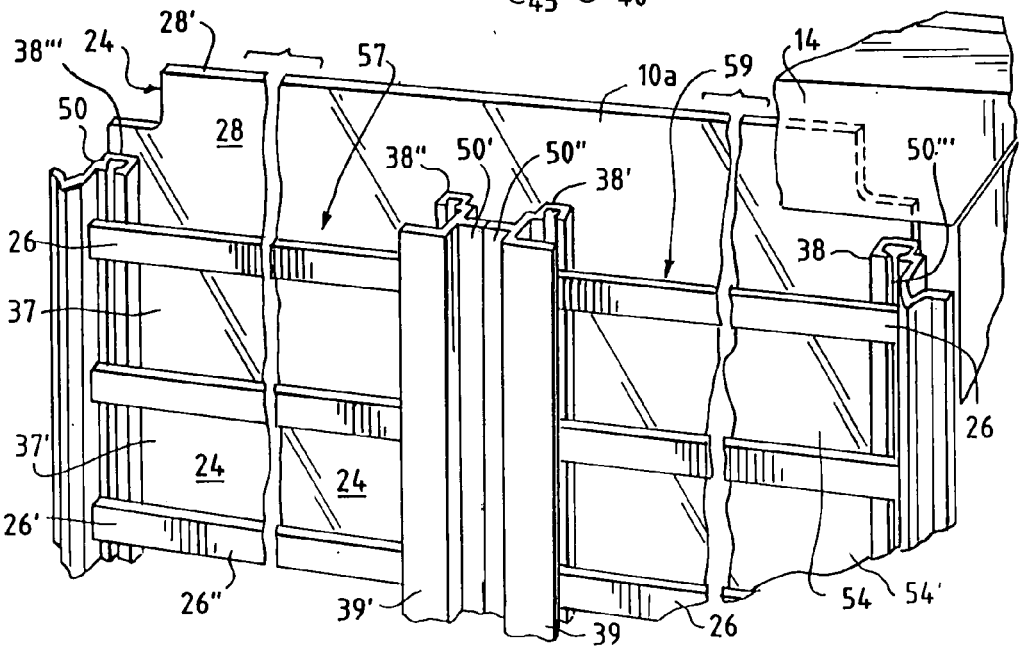
FIG. 4 is a representative front perspective fragmentary view of a display module inserted in an upper wall of the housing in accordance with the invention.

Elongated members 38, 38', 38" and 38'" and retention members 34, 34', 34" and 34'" are preferably aluminum or plastic extrusions and may be integrally formed with one another. Additionally, divider members 26 and 26' are preferably aluminum extrusions. Alternatively, the elongated members, retention members, and divider members may be of any other relatively rigid material. Members 38' and 38" preferably include a lip 39, 39' located on a front portion thereof, behind which is located one end of divider members 26, as shown in FIGS. 3 and 4.

Alternatively, the retention members may be directly secured to the panel, for example, by suitable fastener materials, such as rivets, screws, adhesive, or by any other securement material or member. Further, the retention members may be extruded along with the panel and thus be integral with the panel, preferably from aluminum.

Each divider member 26 is removably held in place by the opposed, secured retention members such that the divider members can be removed and replaced as desired. Preferably, each divider member has a male portion and the retaining members each include a mating female portion such that the divider members are held in place by opposed retention members.

Figure 10:
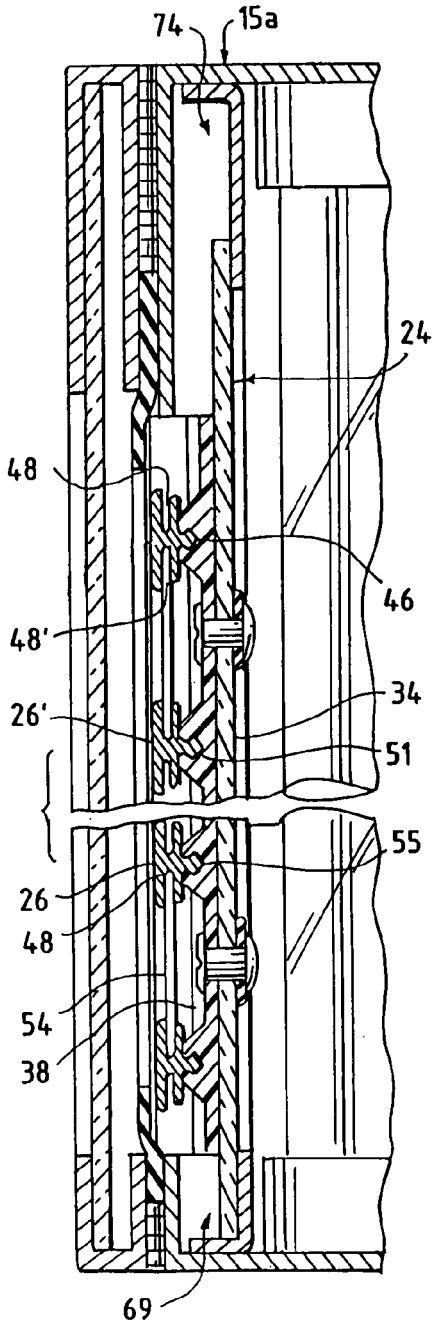
FIG. 10 is a sectional side elevation view along line 10-10 of FIG. 5.

For example, in one embodiment, as shown in FIGS. 3 and 10, divider members 26, 26' have a front portion 44, 44' with an "H-shaped" cross-section and integral rear portions 46, 46'. The "H-shaped" cross-section defines an opposed pair of longitudinally extending channels 48, 48' in divider member 26, for example. Integral rear portion 46 of divider member 26 defines an inwardly extending clip member 55 (male portion) adapted to be releasably engageable with an opposed pair of retention members 34, 34'. Retention members 34, 34' therefore, preferably include a female portion 51, 51', respectively, for example as in a clip 53, 53' for engaging inwardly extending clip member 55 of divider member 26. Preferably, each divider member 26 is only engageable to the retention member 34 in a direction perpendicular to the plane of panel 24, as is also shown in FIGS. 3 and 10.

It is contemplated that each of display modules 10*a-d* may include at least four columns 50, 50', 50", 50'" of retention members 34, 34', 34", 34'" such that at least a two-section menu board is provided, as shown by display module 10*a* in FIG. 4. By "section" it is meant a plurality of divider members 26, 26' spaced vertically above and below one another. Thus, one section 57 may be for breakfast, for example, and the second section 59 may be for lunch/dinner items, for example. It is contemplated that display modules 10*a-d* may include as few or as many sections as is desired.

The divider members may be spaced apart from one another as desired, for example, by approximately 1 inch to receive an approximately 1 inch display member, or alternatively divider members may be spaced apart by 2 inches or more as desired to retain larger display member advertisements. Thus, it is further contemplated that all available retention members need not be used in order to incorporate larger display members in the display module.

Each divider member 26 includes channels 48 and 48' for retaining portions of information display members 54 having indicia on at least one face thereof, such as relating to food description, pricing, and other information, as shown in FIGS. 2 and 10, for example. In one embodiment, as shown in FIG. 3, divider member 26 includes a pair of longitudinally extending channels 48, 48' in upper divider member 26 and lower divider member 26' to provide channels 48 and 48' for top portion 62 and bottom portion 64 of display member 54, respectively, which act as retaining structures. Longitudinally extending channels 48, 48' preferably extend along substantially the whole longitudinal length of each divider member 26.

Figure 13:
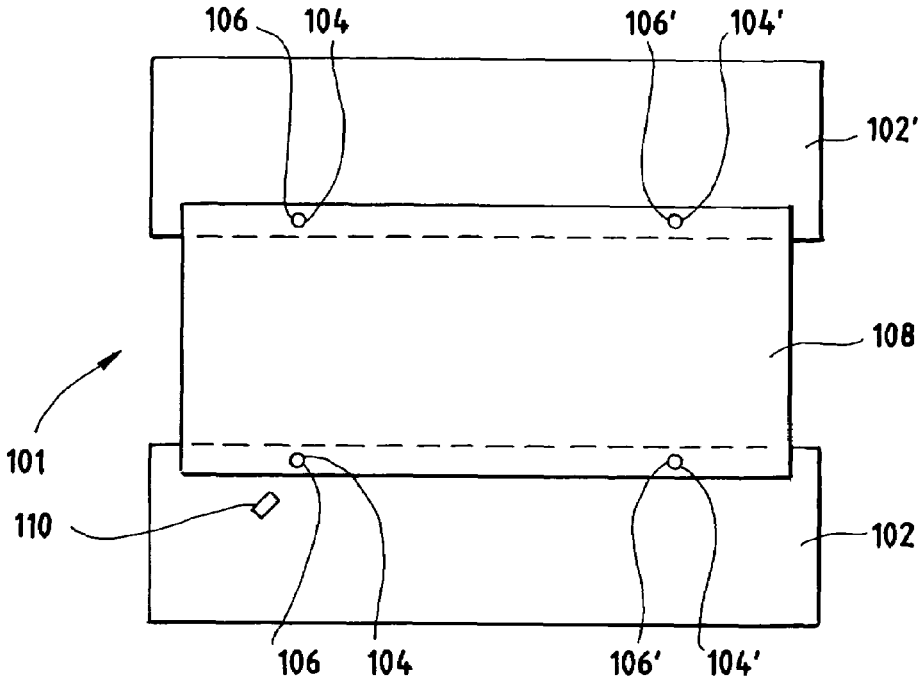
FIG. 13 is a front elevation view of a post-and-hole arrangement in accordance with the invention.

In another embodiment, as shown in fragmentary elevation view in FIG. 13, a portion of a display module 101 includes a post-and-hole arrangement wherein divider members 102, 102' are elongated strips of material with no inward extending portion and no channels. Instead, divider members 102, 102' have at least two apertures 104, 104' which correspond to at least two apertures 106, 106' on an associated display member 108. Once apertures 104, 104' of divider member 102, and apertures 106, 106' of display member 108 are aligned, a post or peg 110 or other suitable device may be inserted in the apertures to retain at least a portion of the display member 108 to the divider member 102. Alternatively, peg 110 may be a permanent or an integral part of divider members 102, 102', for example.

The display members of the present invention may provide food descriptions, pricing information, restaurant or company information, artwork, or any other desired information. Display members 54, 54' are preferably elongated strips, as shown in FIG. 4, which have translucent portions such that when the display module 10 is positioned inside housing 14, light may project through the translucent portions of display members 54, 54' such that the indicia on display members 54, 54' are easily viewable, particularly in darkness, as shown in FIG. 2. Typically, display members 54, 54' are plastic so as to enable the display member to flex in order to be inserted within divider members 26, 26'; however, any other suitable material may be used which has a translucent portion.

Figure 8:
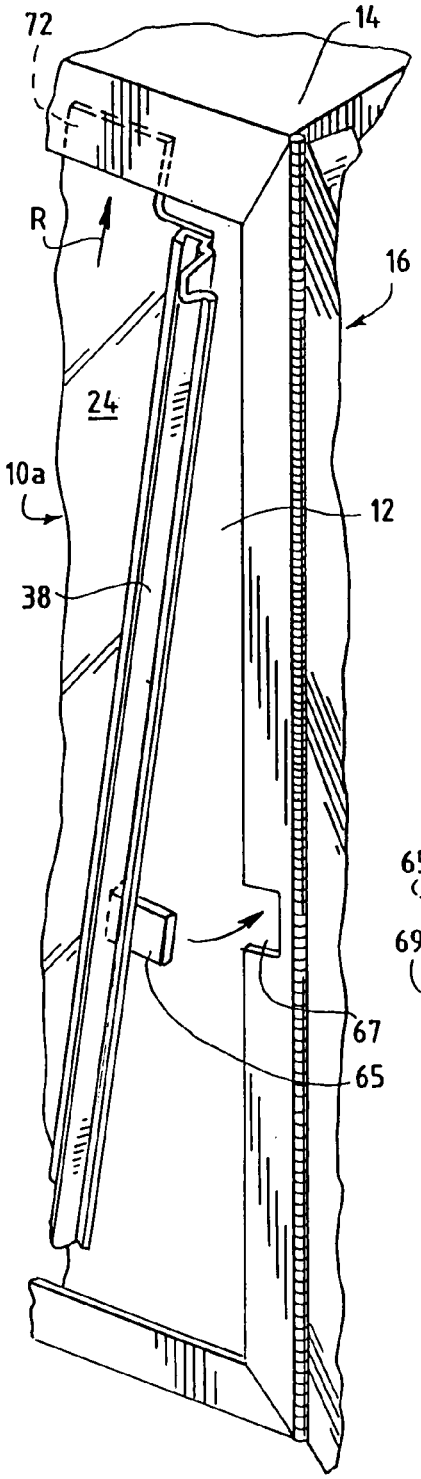
FIG. 8 is a representative fragmentary perspective view illustrating an attachment member for the display module being inserted into a corresponding slot within the housing of the illuminated display device in accordance with the present invention.
Figure 9:
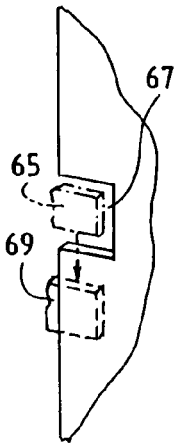
FIG. 9 is a fragmentary perspective view illustrating the direction of movement of the attachment member of FIG. 8 within the body of the illuminated display device.

In accordance with another aspect of the present invention, as shown in FIGS. 8-9, display module 10*a* includes attachment members 65 which extend outward from the body of panel 24. When display module 10*a* is inserted within corresponding slot 67 of housing 14, and lowered within a cavity 69 of housing 14, attachment members 65 facilitate the insertion of display module 10*a* within housing 14 as will be discussed in detail further below. In one embodiment, panel 24 includes L-shaped cut-out portions 68 on each side of panel 24 as shown in FIGS. 2-3, to define a relatively large tab 72 which may be inserted into corresponding slot 74 in the upper wall of the panel to facilitate the insertion of display module 10 in housing 14.

In operation, self-supporting frameless display modules 10*a-d* are assembled from its components as follows. If not already secured to or integral with panel 24, the plurality of opposed pairs of retention members 34 are secured to the panel and arrayed in first and second vertically disposed columns, as shown in FIGS. 3 and 10. For example, as shown in FIG. 3, vertically elongated members 38, 38', 38" (intermediate members), which include retention members 34, 34', 34" on a surface thereof may be secured to panel 24 by inserting grommets 40, 40', 40" through corresponding apertures 42, 42', 42" in panel 24 and corresponding apertures 43, 43', 43" in elongated members 38, 38', 38". Washers 45, 45', 45", preferably of rubber, may also be used when securing elongated members 38, 38', 38" to panel 24.

Each divider member 26 may then be positioned within the respective opposed pairs of retention members. In the embodiment wherein divider member 26 has a front portion 44 with an "H-shaped" cross-section and integral rear portion 46 of divider member 26 defines an inwardly extending clip member 55, inwardly extending clip member 55 is inserted into opposed pairs of retention members 34, 34' to secure divider member 26 in its desired position on display modules 10*a-d*. Divider member 26 may be detached and removed from retention members 34, 34' by pulling divider member 26 in a direction away from panel 24 and slowly turning divider member 26 in a clockwise or counterclockwise direction. A top portion 62 of display member 54 may be inserted into a first longitudinally extending retaining channel 48 of a first dividing member 26 and pushed upward such that display member 54 abuts the deepest portion of channel 48, as shown in FIG. 2. Display member 54 may subsequently be flexed inward to facilitate the insertion of lower edge 64 of the same display member 54 into a second longitudinally extending retaining channel 48' disposed vertically below first longitudinally extending channel 48 on an adjacent second dividing member 26'. Display member 54 may then be firmly held in place within the longitudinally extending channels.

In the embodiment where a divider member 102 includes at least two apertures 104, 104' which correspond to at least two apertures 106, 106' on a display member 108, as shown in FIG. 13, display members 108 may be installed in display module 101 by aligning the apertures 106, 106' of display member 108 with apertures 104, 104' of divider member 102. A peg 110 or other securing member may then be inserted into the apertures to secure display member 108 to divider member 102.

Figure 7:
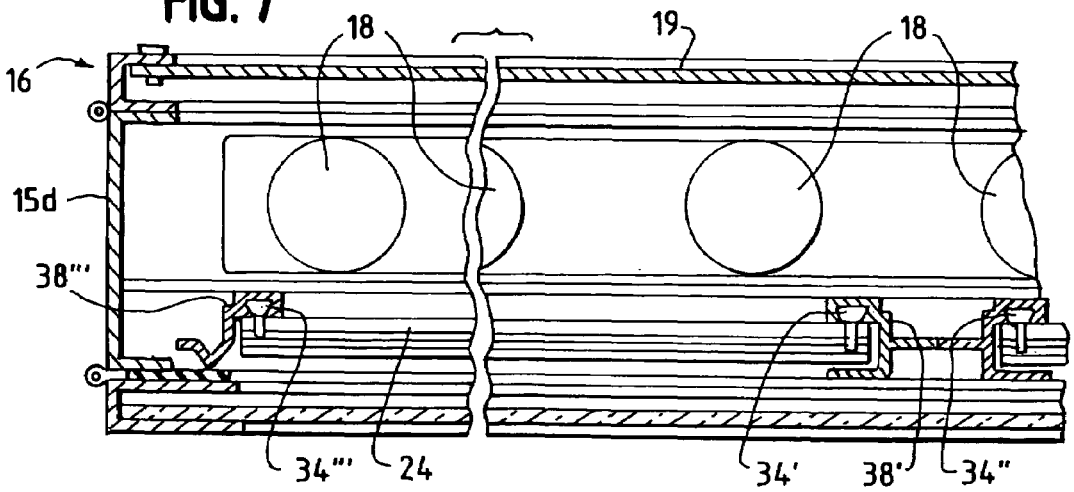
FIG. 7 is a sectional view along line 7-7 of FIG. 5.

The display module is now assembled and ready for insertion into opening 12 of housing 14 of illuminated display device 16. To insert any one of display modules 10*a-d* in housing 14, door 20 is first unlatched and opened to allow access to front opening 12 of housing 14. The relatively large upper tab 72 of display module for 10*a*, for example, may be directed upward in the direction of arrow R into a corresponding slot 74 in upper wall 15*a* of housing 14, as shown in FIGS. 8 and 10. Tabs 65, if present, extending from sides of display modules 10 may be inserted into a corresponding slot 67 in housing 14 and then lowered in a downward direction in cavity 69 to secure the display module in place, as shown in FIG. 9. Fully assembled illuminated display devices including display modules in accordance with the present invention can be found in FIGS. 5 and 7, for example.

Figure 11:
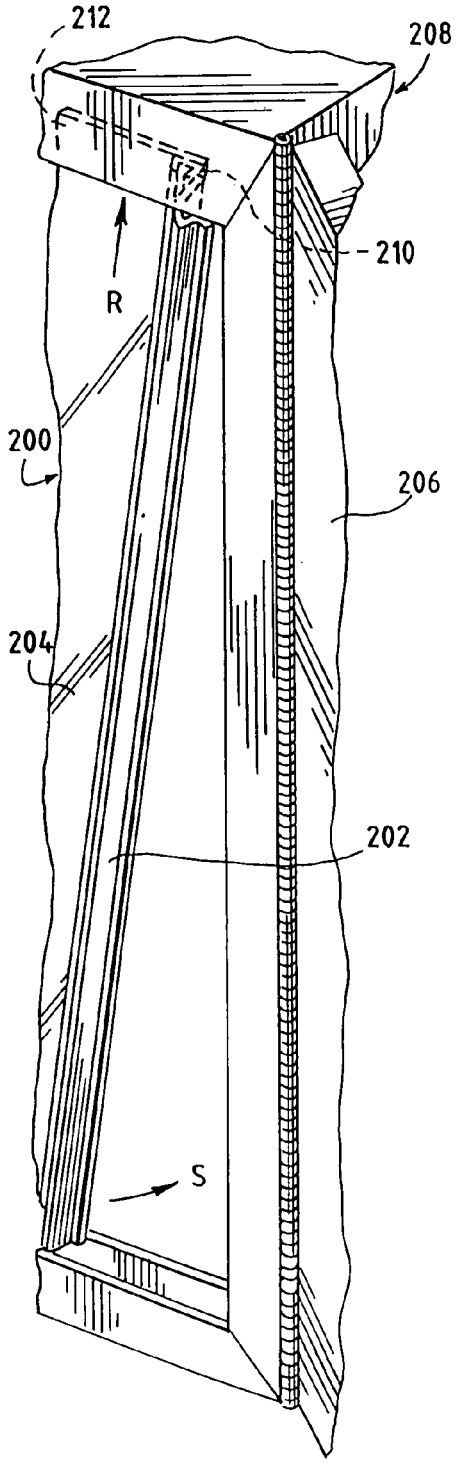
FIG. 11 is a fragmentary perspective view illustrating an elongated member of the display module being inserted into a corresponding slot within a housing of an illuminated display device in accordance with the present invention.
Figure 12:
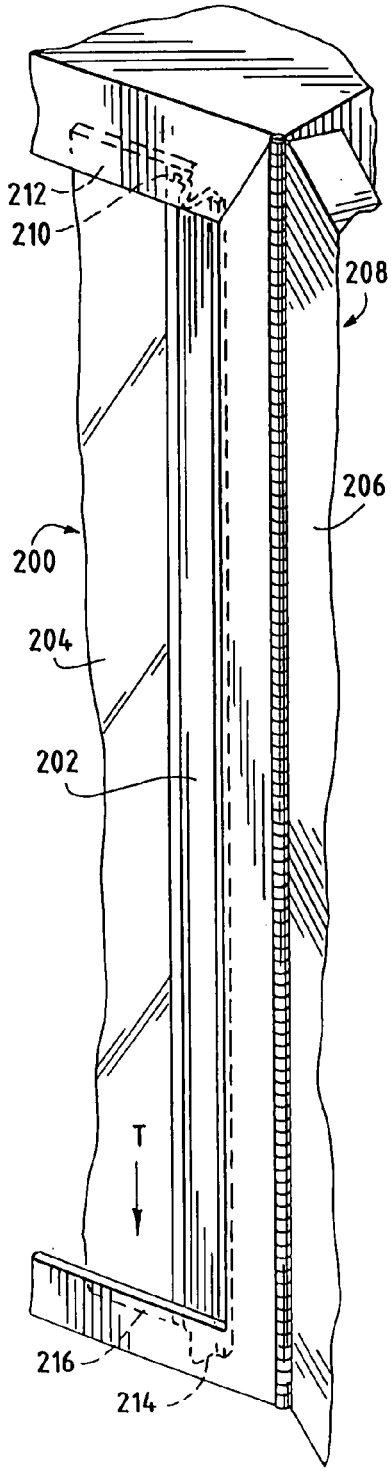
FIG. 12 is a fragmentary perspective view illustrating the assembled position of an elongated member of FIG. 11 within the housing of the illuminated display device in accordance with the present invention.

In another embodiment, display module 200 has elongated members 202 secured to a panel 204 which cooperate with a housing 206 of an illuminated display device 208 to maintain display module 200 within housing 206, as shown in FIGS. 11-12. A top portion 210 of elongated members 202 may be directed upward in the direction shown by arrow R into a corresponding upper slot 212 in housing 206, as shown in FIG. 11. Top portion 210 is pushed flush within upper slot 212 by directing display module 200 within housing 206 in the direction shown by arrow S. Once top portion 210 is inserted into the upper slot 212, a bottom portion 214 of elongated members 202 may be further directed downward in the direction shown by arrow T into a corresponding bottom slot 216 in housing 206, as shown in FIG. 12. Typically, the height of elongated members 202 is greater than the height of panel 204 to which elongated members 202 are secured.

While the invention has been described with respect to certain preferred embodiments, it is to be understood that the invention is capable of numerous changes, modifications, and rearrangements without departing from the scope or spirit of the invention as defined in the claims.

What invention claimed is:

1. An illuminated display device comprising:

a housing having an opening;

at least one lighting source positioned inside the housing for projecting light through the opening;

at least one display module removably disposed within the opening in the housing, the display module comprising a self-supporting, at least substantially translucent panel, a plurality of retention members for removably retaining a plurality of spaced apart divider members, said retention members secured to said panel in fixed relation and arrayed in first and second opposed vertically spaced apart columns, a pair of spaced apart opposed and vertically disposed elongated members mounted to said panel, said retention members being carried by said elongated members, and a plurality of display members attached to said retention members, said display members having translucent portions;

wherein said display module is frameless and wherein the display members are removable from the display module without removal of the display module from the housing.

2. The display device of claim 1 further comprising a plurality of opposed, horizontally disposed divider members positioned over said panel and each of said divider members being individually removably held in place by opposed retention members.

3. The display device of claim 2 further comprising a pair of opposed longitudinally extending channels in each of said divider members for securing portions of display members.

4. The display device of claim 3 wherein the display members are positioned between opposed sets of said channels of said opposed divider members.

5. The display device of claim 4 wherein said divider members and said display members can be removed and replaced in said opposed retention members without disassembly of any of said retention members from said panel.

6. The display device of claim 1 wherein said panel is transparent.

7. The display device of claim 1 wherein said panel comprises polycarbonate material.

8. The display device of claim 2 wherein said divider members are held in place by mating male and female connection members.

9. The display device of claim 2 wherein said divider members are engaged to said retention members in a direction perpendicular to the plane of said panel.

10. The display device of claim 1 wherein the housing further comprises at least one door over the opening, the door providing access to the display device.

11. The display device of claim 10 wherein the door further comprises a substantially translucent or transparent portion through which the display members are visible.

12. The display device of claim 1 wherein the housing further comprises a substantially translucent or transparent portion over the opening through which the display members are visible.

13. The display device of claim 1 wherein the display module further comprises attachment tabs and wherein the housing further comprises cavities, each cavity having a slot, so that the attachment tabs may be inserted into the cavities via the slots in a direction substantially non-parallel to the panel when the display module is removably inserted into the opening.

14. The display device of claim 13 wherein the housing further comprises a horizontal slot for removably holding the display module in the opening.

15. The display device of claim 14 wherein the panel has an extended tab, the extended tab being adapted to be inserted into the horizontal slot.

16. A method of assembling an illuminated display device comprising:

(a) assembling a display module by the method comprising:

providing a plurality of opposed pairs of retention members in fixed relation and arrayed in first and second opposed vertically spaced apart columns;

attaching a plurality of display members to said retention members, said display members having translucent portions; and providing attachment tabs extending outwardly from the display module (b) providing a housing having an opening and cavities, each cavity having a slot to align with the attachment tabs;

(c) positioning at least one lighting source inside the housing for projecting light through the opening; and (d) inserting the attachment tabs into the cavities via the slots in a direction substantially non-parallel to the panel to position the display module in the opening.

17. The method of claim 16 wherein providing a plurality of opposed pairs of retention members comprises securing a plurality of opposed pairs of retention members to a self-supporting, at least substantially translucent panel.

18. The method of claim 17 wherein the display module is frameless.

19. The method of claim 16 further comprising removably securing a plurality of opposed, horizontally disposed divider members to respective opposed pairs of said retention members, each of said divider members having a retaining structure thereon for retaining display members;

wherein attaching a plurality of display members to said retention members comprises positioning in a retaining relationship a plurality of display members between opposed sets of divider members.

20. The method of claim 16 wherein the panel has an extended tab and the housing has a horizontal slot, the method further comprising inserting the extended tab into the horizontal slot.

21. The method of claim 16 further comprising mounting a door to the housing, the door at least partially covering the opening.

22. An illuminated display device comprising:

a housing having an opening, wherein the housing further comprises cavities, each cavity having a slot;

at least one lighting source positioned inside the housing for projecting light through the opening;

at least one frameless display module removably disposed within the opening in the housing, the display module comprising a self-supporting, at least substantially translucent panel, and a plurality of retention members for removably retaining a plurality of spaced apart divider members, said retention members secured to said panel in fixed relation and arrayed in first and second opposed vertically spaced apart columns; and a door mounted to the housing and at least partially covering the opening, the door comprising a substantially translucent or transparent portion through which the display module may be viewed.

wherein the display module further comprises attachment tabs so that the attachment tabs may be inserted into the cavities via the slots in a direction substantially non-parallel to the panel when the display module is removably disposed within the opening.

23. The display device of claim 22 further comprising a plurality of opposed, horizontally disposed divider members positioned over said panel and each of said divider members being individually removably held in place by opposed retention members.

24. The display device of claim 23 further comprising a pair of opposed longitudinally extending channels in each of said divider members for securing portions of said display members.

25. The display device of claim 24 further comprising a plurality of display members positioned between opposed sets of said channels of said opposed divider members, said display members having translucent portions, said display members removable from the display module without removal of the display module from the housing.

26. The display device of claim 22 wherein the housing further comprises a horizontal slot for removably holding the display module in the opening.

27. The display device of claim 26 wherein the panel has an extended tab, the extended tab being adapted to be inserted into the horizontal slot.

* * * * *

UNITED STATES PATENT AND TRADEMARK OFFICE

CERTIFICATE OF CORRECTION

PATENT NO. : 7,308,769 B2
APPLICATION NO. : 10/801724
DATED : December 18, 2007
INVENTOR(S) : Lawrence Labedz It is certified that error appears in the above-identified patent and that said Letters Patent is hereby corrected as shown below:

On the title page item (73), "Everygreen" should be changed to --Evergreen--.

Column 5, lines 35-45, cancel the text beginning with "Panel 24 is constructed of..." and ending with "...within illuminated display device 16."

Column 8, line 32, delete "for" (first occurrence).

Signed and Sealed this

Twentieth Day of May, 2008

JON W. DUDAS
*Director of the United States Patent and Trademark Office*